US012156540B2

(12) United States Patent
Vanko et al.

(10) Patent No.: US 12,156,540 B2
(45) Date of Patent: Dec. 3, 2024

(54) AEROSOL GENERATING SYSTEM

(71) Applicant: JT International S.A., Geneva (CH)

(72) Inventors: Daniel Vanko, Krpelany (SK); Branislav Zigmund, Vrbovce (SK)

(73) Assignee: JT International S.A. (CH)

( * ) Notice: Subject to any disclaimer, the term of this patent is extended or adjusted under 35 U.S.C. 154(b) by 369 days.

(21) Appl. No.: 17/780,259

(22) PCT Filed: Nov. 24, 2020

(86) PCT No.: PCT/EP2020/083120
§ 371 (c)(1),
(2) Date: May 26, 2022

(87) PCT Pub. No.: WO2021/105078
PCT Pub. Date: Jun. 3, 2021

(65) Prior Publication Data

US 2022/0408824 A1 Dec. 29, 2022

(30) Foreign Application Priority Data

Nov. 26, 2019 (EP) ..... 19211420

(51) Int. Cl.
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
None
See application file for complete search history.

(56) References Cited

U.S. PATENT DOCUMENTS

2016/0150825 A1* 6/2016 Mironov ..... A24F 40/465 219/634
2017/0071250 A1* 3/2017 Mironov ..... A24F 40/465
2020/0060348 A1* 2/2020 Mironov ..... A24F 40/42
2020/0253283 A1* 8/2020 Vanko ..... H05B 6/108
2020/0329771 A1* 10/2020 Vanko ..... H01F 27/346

FOREIGN PATENT DOCUMENTS

WO 2017191176 A1 11/2017
WO 2019129637 A1 7/2019
WO 2019207023 A1 10/2019
WO 2019219740 A1 11/2019

OTHER PUBLICATIONS

International Search Report for Application No. PCT/EP2020/083120 mailed Feb. 16, 2021, pp. 1-3.

* cited by examiner

*Primary Examiner* — Cynthia Szewczyk
(74) *Attorney, Agent, or Firm* — Lerner David LLP

(57) ABSTRACT

An aerosol generating system comprises an aerosol generating substrate, an inductor for generating a primary electromagnetic field, a primary susceptor configured to be inductively heated by the primary electromagnetic field and to solely heat the aerosol generating substrate, and a secondary susceptor configured to solely generate a secondary electromagnetic field. The secondary electromagnetic field is generated under the influence of the primary electromagnetic field and acts in opposition to the primary electromagnetic field.

15 Claims, 4 Drawing Sheets

AEROSOL GENERATING SYSTEM

CROSS-REFERENCE TO RELATED APPLICATIONS

The present application is a national phase entry under 35 U.S.C. § 371 of International Application No. PCT/EP2020/083120, filed on Nov. 24, 2020, published in English, which claims priority from European Application No. 19211420.5 filed Nov. 26, 2019, the disclosures of all of which are incorporated herein by reference.

TECHNICAL FIELD

The present disclosure relates generally to an aerosol generating system, and more particularly to an aerosol generating system for heating an aerosol generating substrate to generate an aerosol for inhalation by a user.

TECHNICAL BACKGROUND

Devices which heat, rather than burn, an aerosol generating substrate to produce an aerosol for inhalation have become popular with consumers in recent years. Such devices can use one of a number of different approaches to provide heat to the aerosol generating substrate.

One such approach is to provide an aerosol generating device which employs an induction heating system. In such a device, an induction coil (also referred to as an inductor) is provided with the device and a susceptor is provided, for example with the aerosol generating substrate. Electrical energy is provided to the inductor when a user activates the device which in turn generates an alternating electromagnetic field. The susceptor couples with the electromagnetic field and generates heat which is transferred, for example by conduction, to the aerosol generating substrate thereby generating a vapour which typically cools and condenses to form an aerosol for inhalation by a user of the device.

Such an approach has the potential to provide better control of heating and therefore aerosol generation. However, a shortcoming of the use of an induction heating system is that leakage of the electromagnetic field generated by the inductor may occur and there is, therefore, a need to address this shortcoming.

SUMMARY OF THE DISCLOSURE

According to a first aspect of the present disclosure, there is provided an aerosol generating system comprising:

- an aerosol generating substrate;
- an inductor for generating a primary electromagnetic field;
- a primary susceptor configured to be inductively heated by the primary electromagnetic field and to solely heat the aerosol generating substrate;
- a secondary susceptor configured to solely generate a secondary electromagnetic field acting in opposition to the primary electromagnetic field, wherein the secondary electromagnetic field is generated under the influence of the primary electromagnetic field.

The aerosol generating system, and more specifically the primary susceptor, is configured to heat the aerosol generating substrate, without burning the aerosol generating substrate, to volatise at least one component of the aerosol generating substrate and thereby generate a vapour which cools and condenses to form an aerosol for inhalation by a user of the aerosol generating system. In particular, the primary susceptor is heated by the primary electromagnetic field due to eddy currents and/or magnetic hysteresis losses resulting in a conversion of energy from electromagnetic to heat, and the aerosol generating substrate is heated solely by heat transferred from the primary susceptor.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The primary electromagnetic field is attenuated by the secondary electromagnetic field acting in opposition to the primary electromagnetic field, thereby reducing electromagnetic leakage from the aerosol generating system without the need for a complex electromagnetic shield structure. The purpose of the secondary susceptor is to attenuate the primary electromagnetic field. The secondary susceptor does not heat the aerosol generating substrate.

The aerosol generating system may comprise a housing. The housing may define a device boundary and the secondary electromagnetic field may be configured to attenuate the primary electromagnetic field to produce a net field boundary which lies at least partly, and possibly completely, within the device boundary. By configuring the aerosol generating system to produce a net field boundary which lies at least partly, and possibly completely, within the device boundary, the exposure of a user of the aerosol generating system to the electromagnetic field may be reduced.

The secondary susceptor may have a lower electrical resistivity than the primary susceptor. The lower electrical resistivity (in other words higher electrical conductivity) of the secondary susceptor ensures that electrical current induced in the secondary susceptor by the primary electromagnetic field does not cause substantial heating of the secondary susceptor and, hence, of other component parts of the aerosol generating system proximate the secondary susceptor. In contrast, the higher electrical resistivity of the primary susceptor ensures that the primary susceptor is heated efficiently by the primary electromagnetic field. The primary susceptor may comprise a first material and the secondary susceptor may comprise a second material having a lower electrical resistivity than the first material. In an example, the first material may comprise aluminium and the second material may comprise copper. Alternatively or in addition, the lower electrical resistivity of the secondary susceptor could be achieved based on the geometrical properties of the primary and secondary susceptors, e.g., the secondary susceptor could have a greater thickness than the primary susceptor. In this case, the primary susceptor and the secondary susceptor may comprise the same material.

The aerosol generating system may further comprise an electromagnetic shield which may be positioned between the inductor and the secondary susceptor. The electromagnetic shield may comprise a ferrimagnetic, non-electrically conductive material. Examples of suitable materials for the electromagnetic shield include, but are not limited to, ferrite, Nickel Zinc Ferrite and mu-metal. The electromagnetic shield may comprise a laminate structure and may, thus, comprise a plurality of layers. The layers may comprise the same material or may comprise a plurality of different materials, for example which are selected to provide the desired shielding properties. The electromagnetic shield may reduce electromagnetic coupling between the primary electromagnetic field and the secondary susceptor, thereby ensuring that a maximum amount of energy is transferred from the inductor to the primary susceptor.

The inductor may comprise a helical induction coil and the primary susceptor may be arranged inside the helical induction coil. In the context of the present disclosure, the term 'helical induction coil' includes an induction coil with any suitable cross-sectional shape with respect to a winding axis of the coil, including but not limited to circular, elliptical, square and rectangular.

The primary susceptor may comprise a plurality of first susceptor discs arranged inside the induction coil. This arrangement may provide an enhanced electromagnetic coupling between the primary electromagnetic field and the plurality of first susceptor discs, thereby ensuring that the aerosol generating substrate is heated efficiently. In other embodiments, the primary susceptor may be strip-shaped or plate-shaped, may be stick-shaped, may be U-shaped, may be E-shaped, may be I-shaped, may be pin-shaped or may be tubular, for example with a circular, rectangular or square cross-section.

The secondary susceptor may comprise at least one susceptor disc (e.g. a copper disc) positioned at an axial end of the helical induction coil. In some embodiments, the secondary susceptor may comprise a pair of susceptor discs (e.g. copper discs) positioned at opposite axial ends of the helical induction coil. The or each susceptor disc may have an aperture therein and may comprise a susceptor ring. Such an arrangement may facilitate the generation of an electrical current in the susceptor disc(s), and hence the generation of the secondary electromagnetic field, under the influence of the primary electromagnetic field.

The secondary susceptor may comprise a susceptor mesh (e.g. a copper mesh) which may surround at least part of the helical induction coil. Such an arrangement may facilitate the generation of an electrical current in the susceptor mesh, and hence the generation of the secondary electromagnetic field, under the influence of the primary electromagnetic field.

The secondary susceptor may partially or fully enclose the inductor (e.g. helical induction coil), the primary susceptor and the aerosol generating substrate. For example, the secondary susceptor may comprise a cup-shaped susceptor element or a pair of cup-shaped susceptor elements, e.g., positioned at opposite axial ends of a helical induction coil. In embodiments in which the secondary susceptor fully encloses the inductor (e.g. helical induction coil), the primary susceptor and the aerosol generating substrate, the secondary susceptor may include one or more openings to permit the flow of air and vapour through the aerosol generating system and to permit the inductor to be electrically connected to a power source and controller.

In some embodiments, the secondary susceptor may comprise the housing. Such an arrangement, in which the housing acts as the secondary susceptor, obviates the need to provide additional components (e.g. a susceptor disc or a susceptor mesh) to act as the secondary susceptor. This may advantageously help to simplify the structure of the aerosol generating system and thereby reduce the size and/or weight of the system.

The primary susceptor and the aerosol generating substrate may be integrated into a planar body having main surfaces, and the inductor may comprise a pair of coil plates arranged on opposite sides of the planar body and each having a first surface which faces a corresponding main surface of the planar body. Each coil plate may include a planar induction coil, such as a spirally wound coil with a winding axis which is perpendicular to the surface in which the coil plate lies. The planar coils may lie in a flat plane and the planar coils may, thus, be flat coils. Such an arrangement may facilitate manufacture of the aerosol generating system.

Each of the coil plates may have a second surface opposite the first surface and the secondary susceptor may comprise a pair of susceptor plates each of which may be positioned adjacent to the second surface of a respective coil plate. The electromagnetic shield may comprise a pair of electromagnetic shield members and one of said electromagnetic shield members may be positioned between each coil plate and the adjacent susceptor plate. Each electromagnetic shield member may comprise a ferrite slab. Such an arrangement may simplify the structure of the aerosol generating system.

The aerosol generating system may further comprise an air-gap layer which may be positioned between each coil plate and the adjacent electromagnetic shield member. Such an arrangement may improve the shielding effect and/or help to reduce heat transfer to other components of the aerosol generating system. This may in turn improve user comfort, for example by reducing the temperature of an outer surface of the aerosol generating system.

Each air-gap layer may include a thermally insulating material. The thermally insulating material may include a ceramic or foam glass. The use of a thermally insulating material may help to further reduce heat transfer to other components of the aerosol generating system.

The secondary susceptor may act as an electrical conductor and the aerosol generating system may comprise a self-oscillating circuit formed by the inductor and the secondary susceptor. For example, each planar coil may include a first electrode which may be connected to a power source and controller and a second electrode which may be connected to an adjacent susceptor plate, for example by a rivet or a soldered connection. The second electrodes, and hence the susceptor plates, may be connected to each other by a center tap, thereby forming a self-oscillating circuit.

The aerosol generating system may comprise an aerosol generating device in which the inductor is incorporated. The aerosol generating device may include a cavity having a longitudinal axis.

In embodiments in which the inductor comprises a helical induction coil, the helical induction coil may extend around the cavity such that the longitudinal axes of the helical induction coil and the cavity are substantially parallel.

In embodiments in which the inductor comprises a pair of coil plates, the coil plates may be arranged on opposite sides of the cavity, with the first surface of each coil plate facing the cavity.

The inductor may comprise any suitable material, for example a Litz wire or a Litz cable.

The aerosol generating substrate may comprise a non-liquid aerosol generating substrate, for example any type of solid or semi-solid material. Example types of aerosol generating substrates include powder, granules, pellets, shreds, strands, particles, gel, strips, loose leaves, cut leaves, cut filler, porous material, foam material or sheets. The non-liquid aerosol generating substrate may comprise plant derived material and in particular, may comprise tobacco. It may advantageously comprise reconstituted tobacco.

The aerosol generating substrate may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis. In some embodiments, the aerosol generating substrate may comprise an aerosol-former content of between approximately 10% and approximately 20% on a dry weight basis, and possibly approximately 15% on a dry weight basis.

Upon heating, the aerosol generating substrate may release volatile compounds. The volatile compounds may include nicotine or flavour compounds such as tobacco flavouring.

The inductor may be arranged to operate in use with a fluctuating electromagnetic field having a magnetic flux density of between approximately 20 mT and approximately 2.0 T at the point of highest concentration.

The aerosol generating system may include a power source and controller which may be configured to operate at a high frequency. The power source and controller may be configured to operate at a frequency of between approximately 100 kHz and 900 kHz, possibly between approximately 350 kHz and 450 kHz, and possibly at approximately 400 kHz. The power source and controller could be configured to operate at a higher frequency, for example in the MHz range, depending on the type of inductively heatable susceptor (in particular primary susceptor) that is used.

The aerosol generating system may comprise an aerosol generating article which includes the aerosol generating substrate and the primary susceptor. The aerosol generating article may be substantially cylindrical or may be substantially plate-shaped.

The aerosol generating article may comprise an air-permeable shell and the aerosol generating substrate and the primary susceptor may be positioned inside the air-permeable shell. The air-permeable shell may comprise an air permeable material which is electrically insulating and non-magnetic. The material may have a high air permeability to allow air to flow through the material with a resistance to high temperatures. Examples of suitable air permeable materials include cellulose fibres, paper, cotton and silk. The air-permeable material may also act as a filter.

The plate-shaped aerosol generating article may comprise a substantially planar aerosol generating substrate and a substantially planar primary susceptor. The substantially planar aerosol generating substrate could comprise two substantially planar layers of aerosol generating material and the substantially planar primary susceptor could be positioned between the two substantially planar layers of aerosol generating material.

DETAILED DESCRIPTION OF EMBODIMENTS

Embodiments of the present disclosure will now be described by way of example only and with reference to the accompanying drawings.

Figure 1:
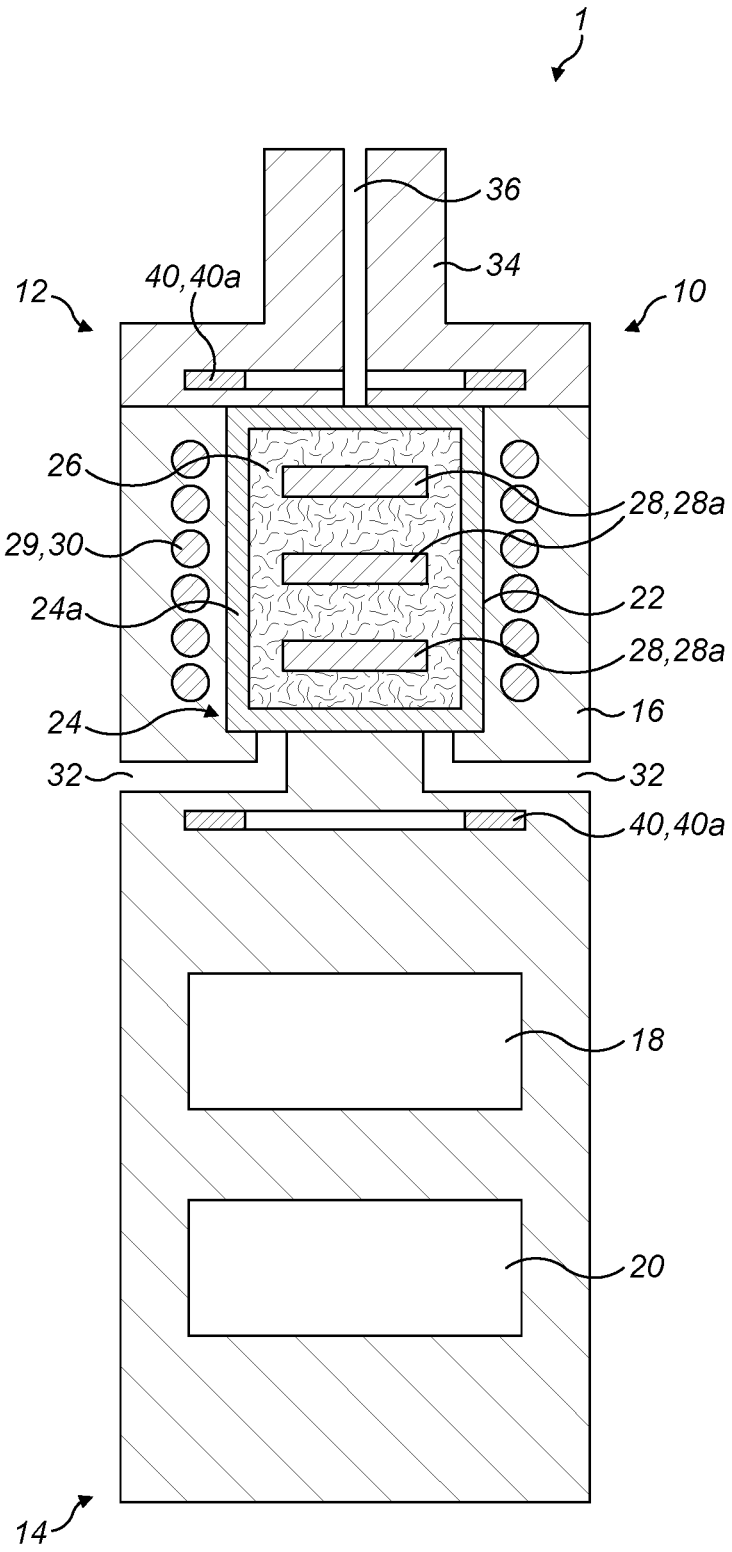
FIG. 1 is a diagrammatic view of a first example of an aerosol generating system.

Referring initially to FIG. 1, there is shown diagrammatically a first example of an aerosol generating system 1. The aerosol generating system 1 comprises a first example of an aerosol generating device 10 and an aerosol generating article 24. The aerosol generating device 10 has a proximal end 12 and a distal end 14 and comprises a device housing 16 which includes a power source 18 and a controller 20 which may be configured to operate at high frequency. The power source 18 typically comprises one or more batteries which could, for example, be inductively rechargeable.

The aerosol generating device 10 is generally cylindrical and comprises a generally cylindrical cavity 22, for example in the form of a heating compartment, at the proximal end 12 of the aerosol generating device 10. The cylindrical cavity 22 is arranged to receive a correspondingly shaped generally cylindrical aerosol generating article 24 containing an aerosol generating substrate 26 and a primary inductively heatable susceptor 28, for example in the form of first susceptor discs 28*a* formed of aluminium. The aerosol generating article 24 can comprise a non-metallic and air-permeable outer shell 24*a* to contain the aerosol generating substrate 26 and first susceptor discs 28*a* and to allow air to flow through the aerosol generating article 24. The aerosol generating article 24 is a disposable article which may, for example, contain tobacco as the aerosol generating substrate 26.

The aerosol generating device 10 comprises an inductor 29 in the form of a helical induction coil 30 which has a circular cross-section and which extends around the cylindrical cavity 22. In other non-illustrated embodiments, the helical induction coil may have a non-circular cross-section, for example elliptical, square or rectangular. The induction coil 30 can be energised by the power source 18 and controller 20. The controller 20 includes, amongst other electronic components, an inverter which is arranged to convert a direct current from the power source 18 into an alternating high-frequency current for the induction coil 30.

The aerosol generating device 10 includes one or more air inlets 32 in the device housing 16 which allow ambient air to flow into the cylindrical cavity 22. The aerosol generating device 10 also includes a mouthpiece 34 having an air outlet 36. The mouthpiece 34 is removably mounted on the device housing 16 at the proximal end 12 to allow access to the cylindrical cavity 22 for the purposes of inserting or removing an aerosol generating article 24.

Figure 2C:
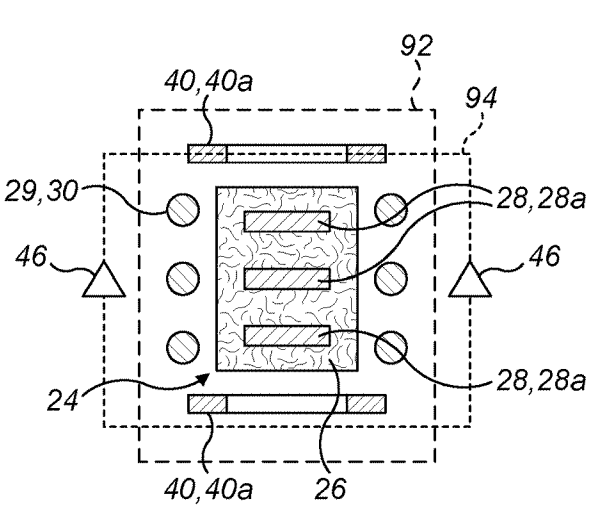
FIGS. 2*a* to 2*c* are diagrammatic views of part of the aerosol generating system of FIG. 1 illustrating the attenuation of a primary electromagnetic field by a secondary electromagnetic field, and in which the orientation and size of the triangular symbols are intended to denote respectively the direction and strength of the electromagnetic field.
Figure 2B:
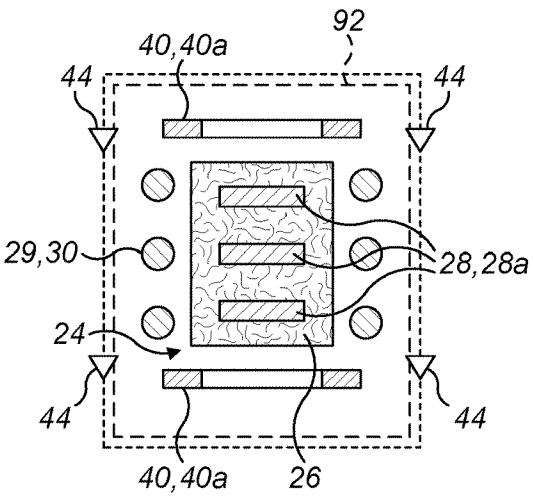
Figure 2A:
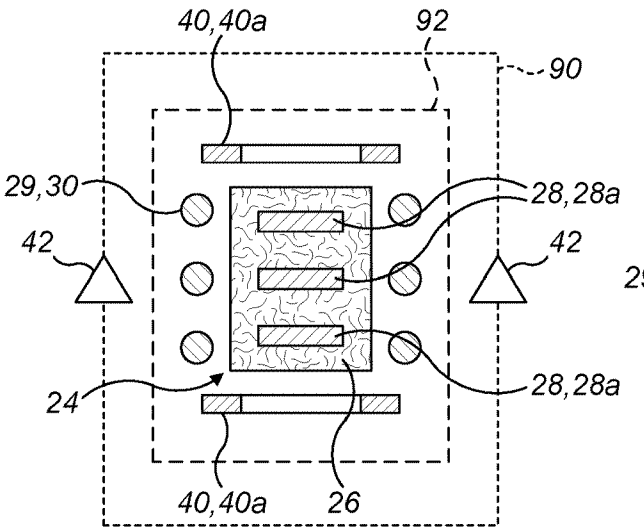

As will be understood by one of ordinary skill in the art, when the induction coil 30 is energised during use of the aerosol generating system 1, an alternating and time-varying primary electromagnetic field 42 is produced as denoted schematically in FIG. 2*a* by the triangular symbols. The primary electromagnetic field 42 couples with the primary susceptor 28 and generates eddy currents and/or magnetic hysteresis losses in the first susceptor discs 28*a* causing them to heat up. As shown diagrammatically in FIG. 2*a*, the primary electromagnetic field 42 has a field boundary 90 that lies outside the boundary 92 of the aerosol generating device 10, for example as defined by the exterior of the device housing 16.

The first susceptor discs 28*a* can be in direct or indirect contact with the aerosol generating substrate 26, such that when the first susceptor discs 28*a* are inductively heated by the primary electromagnetic field 42 generated by the induction coil 30, heat is transferred from the first susceptor discs 28*a* to the aerosol generating substrate 26, for example by conduction, radiation and convection, to heat the aerosol generating substrate 26 without burning and thereby generate a vapour. The vaporisation of the aerosol generating substrate 26 is facilitated by the addition of air from the surrounding environment through the air inlets 32. The vapour generated by heating the aerosol generating substrate 26 exits the cylindrical cavity 22 through the air outlet 36 where it cools and condenses to form an aerosol that can be inhaled by a user of the device 10 through the mouthpiece 34. The flow of air through the cylindrical cavity 22, i.e. from the air inlets 32, through the cavity 22 and out of the air outlet 36 in the mouthpiece 34, can be aided by negative pressure created by a user drawing air from the air outlet 36 side of the device 10.

In addition to the primary susceptor 28 (i.e. the first susceptor discs 28*a* in the illustrated example), the aerosol generating system 1, and more particularly the aerosol generating device 10, includes a secondary susceptor 40. In the illustrated example, the secondary susceptor 40 comprises a pair of second susceptor discs 40*a* positioned at opposite axial ends of the helical induction coil 30. The second susceptor discs 40*a* may be ring-shaped as shown in FIG. 1. It may be advantageous to form the second susceptor discs 40*a* from a material (e.g. copper) which has a lower electrical resistivity than the material (e.g. aluminium) from which the first susceptor discs 28*a* are formed.

The second susceptor discs 40*a* are configured to generate a secondary electromagnetic field 44 as shown diagrammatically in FIG. 2*b* by the triangular symbols, under the influence of the primary electromagnetic field 42 generated by the induction coil 30. More particularly, the primary electromagnetic field 42 is absorbed by the second susceptor discs 40*a*, inducing an electrical current flow in the second susceptor discs 40*a* which generates a secondary electromagnetic field 44 that acts in opposition (e.g. by 180 degrees as shown in FIG. 2*b*) to the primary electromagnetic field 42. By acting in opposition to the primary electromagnetic field 42, the secondary electromagnetic field 44 attenuates the primary electromagnetic field 42 such that the resultant net electromagnetic field 46, shown schematically in FIG. 2*c* by the triangular symbols, has a net field boundary 94 that lies at least partly within the device boundary 92 of the aerosol generating device 10. As a result, the exposure of a user of the aerosol generating system 1 to the electromagnetic field can be reduced when compared to an aerosol generating device which does not employ a secondary susceptor 40.

Figure 3:
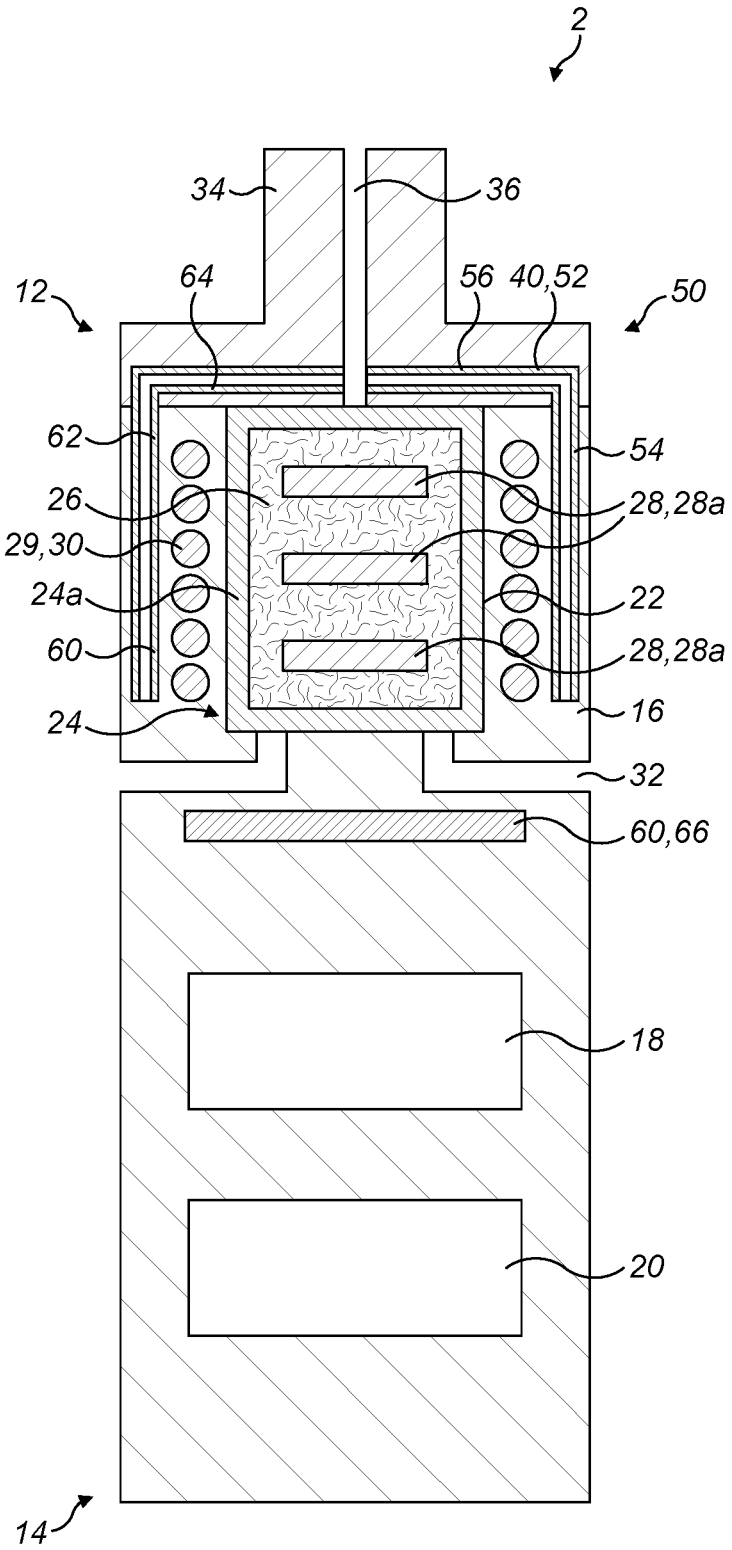
FIG. 3 is a diagrammatic view of a second example of an aerosol generating system.

Referring now to FIG. 3, there is shown a second example of an aerosol generating system 2 which is similar to the first example of the aerosol generating system 1 described above with reference to FIGS. 1 and 2 and in which corresponding components are identified using the same reference numerals.

The aerosol generating system 2 comprises a second example of an aerosol generating device 50 which is similar to the first example of the aerosol generating device 10 described above, and also comprises an aerosol generating article 24 as described above.

The aerosol generating device 50 includes a secondary susceptor 40 in the form of a susceptor mesh 52, for example formed of copper. The susceptor mesh 52 at least partially surrounds the helical induction coil 30. In the illustrated example, the susceptor mesh 52 comprises a substantially cylindrical mesh portion 54 and a substantially circular mesh portion 56 provided at an axial end of the induction coil 30.

The susceptor mesh 52 is configured to generate a secondary electromagnetic field 44, under the influence of the primary electromagnetic field 42 generated by the induction coil 30. More particularly, the primary electromagnetic field 42 is absorbed by the susceptor mesh 52, inducing an electrical current flow in the susceptor mesh 52 which generates a secondary electromagnetic field 44 that acts in opposition to the primary electromagnetic field 42. The secondary electromagnetic field 44 attenuates the primary electromagnetic field 42 as described above in connection with FIG. 1, such that the resultant net electromagnetic field 46 has a net field boundary 94 that lies at least partly within the device boundary 92 of the aerosol generating device 50.

The aerosol generating device 50 can also include an electromagnetic shield 60 which can be positioned between the induction coil 30 and the susceptor mesh 52. The electromagnetic shield 60 is typically formed of a ferrimagnetic, non-electrically conductive material such as ferrite. In the example shown in FIG. 3, the electromagnetic shield 60 comprises a substantially cylindrical shield portion 62, for example in the form of a substantially cylindrical sleeve, which is positioned radially outwardly of the induction coil 30 so as to extend circumferentially around the induction coil 30. The electromagnetic shield 60 also comprises a first circular shield portion 64, provided at an axial end of the induction coil 30. The electromagnetic shield 60 can also comprise a second circular shield portion 66, which can be provided at a second axial end of the induction coil 30.

Figure 4:
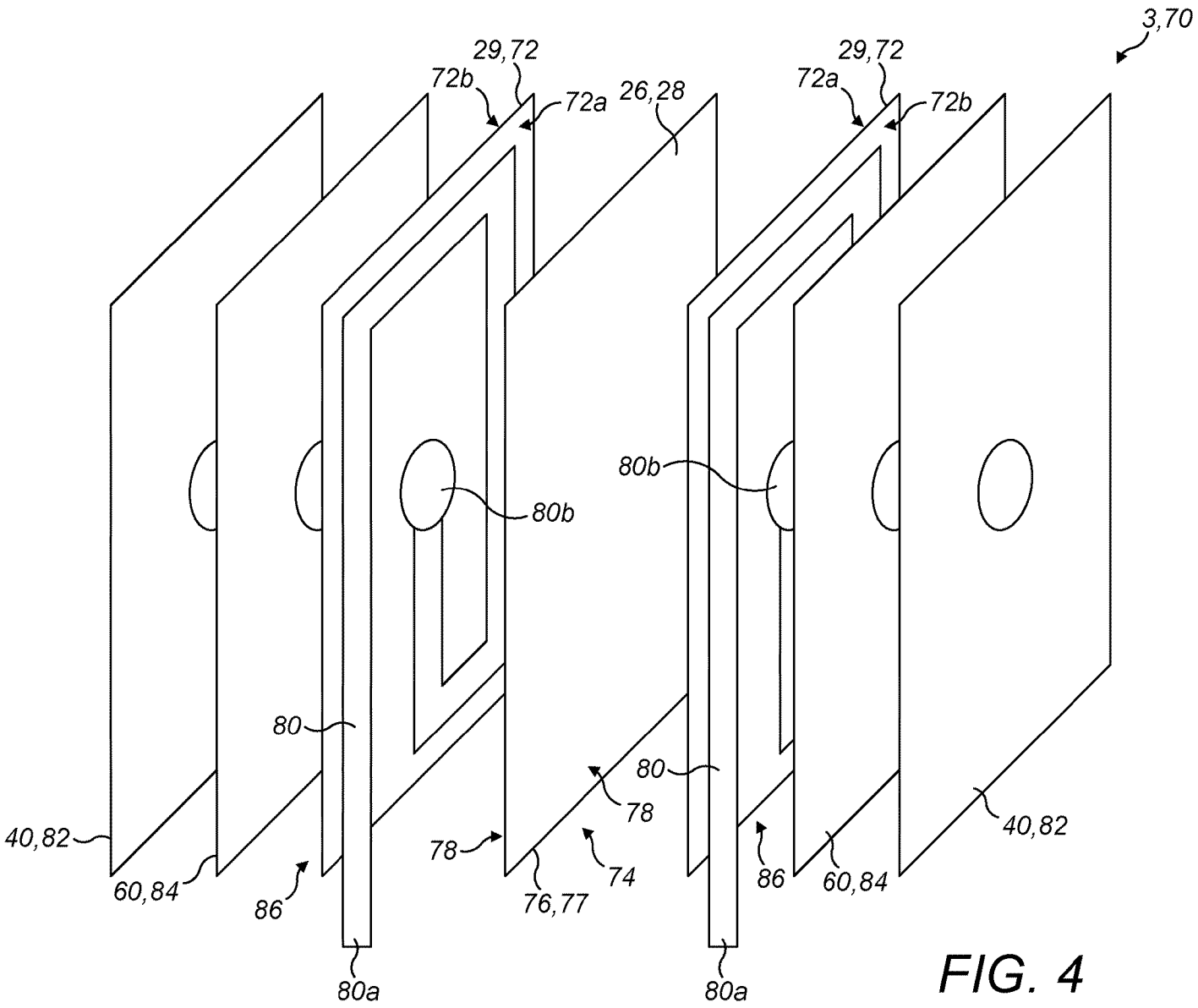
FIG. 4 is a diagrammatic view of part of a third example of an aerosol generating system.

Referring now to FIG. 4, there is shown part of a third example of an aerosol generating system 3 which is similar to the first and second examples of the aerosol generating system 1, 2 described above with reference to FIGS. 1 to 3, and in which corresponding components are identified using the same reference numerals.

The aerosol generating system 3 comprises a third example of an aerosol generating device 70 which shares some similarities with the first and second examples of the aerosol generating device 10, 50 described above and only part of which is shown in FIG. 4. In the aerosol generating device 70, the inductor 29 comprises a pair of coil plates 72 arranged on opposite sides of a cavity 74 adapted to receive a plate-shaped aerosol generating article 76. The plate-shaped aerosol generating article 76 comprises a planar body 77 having main surfaces 78 and includes an aerosol generating substrate 26 and a primary susceptor 28, for example a planar susceptor positioned between two layers of aerosol generating material.

Each coil plate 72 includes a spirally wound planar coil 80 and can be formed as a multilayer printed circuit board in which each planar coil 80 is formed as a copper track. Each coil plate 72 has a first surface 72*a* which faces a corresponding main surface 78 of the planar body 77. In some embodiments, the first surface 72*a* may be coated with a thermally conductive material, for example so that heat losses from the planar coils 80 can reach the aerosol generating substrate 26 to contribute to the heating thereof. The planar coils 80 (flat coils in the illustrated example) are arranged to generate a primary electromagnetic field 42 in the same manner as the helical induction coil 30 described above. Each planar coil 80 includes a first electrode 80*a* which is connected to the power source 18 and controller 20. Each planar coil 80 also includes a second electrode 80*b* and the second electrodes 80*b* can be connected by a center tap (not shown in FIG. 4) which is conventional in the art and does not require further explanation.

The aerosol generating device 70 includes a secondary susceptor 40 in the form of a pair of susceptor plates 82, with each susceptor plate 82 being positioned adjacent to a second surface 72*b* of a respective coil plate 72. The susceptor plates 82 are configured to generate a secondary electromagnetic field 44, under the influence of the primary electromagnetic field 42 generated by the coil plates 72. More particularly, the primary electromagnetic field 42 is absorbed by the susceptor plates 82, inducing an electrical current flow in the susceptor plates 82 which generates a secondary electromagnetic field 44 that acts in opposition to the primary electromagnetic field 42 generated by the coil plates 72. The secondary electromagnetic field 44 attenuates the primary electromagnetic field 42 as described above in connection with FIGS. 1 to 3, such that the resultant net electromagnetic field 46 has a net field boundary 94 that lies at least partly within the boundary 92 of the aerosol generating device 70.

The aerosol generating device 70 can also include substantially planar electromagnetic shield members 84, one of which is positioned between each coil plate 72 and the adjacent susceptor plate 82. Each electromagnetic shield member 84 is typically formed of a ferrimagnetic, non-electrically conductive material and in the illustrated example each electromagnetic shield member 84 comprises a ferrite slab. Each electromagnetic shield member 84 can be spaced from the adjacent coil plate 72 by an air-gap layer 86, and the air-gap layer 86 can include a thermally insulating material such as a ceramic or foam glass to prevent unwanted heat transfer within the aerosol generating device 70, for example from the coil plates 72 to other component parts of the aerosol generating device 70.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating system, comprising:

an aerosol generating substrate;

an inductor for generating a primary electromagnetic field;

a primary susceptor configured to be inductively heated by the primary electromagnetic field and to solely heat the aerosol generating substrate;

a secondary susceptor configured to solely generate a secondary electromagnetic field acting in opposition to the primary electromagnetic field, wherein the secondary electromagnetic field is generated under the influence of the primary electromagnetic field.

2. An aerosol generating system according to claim 1, wherein the aerosol generating system comprises a housing defining a device boundary and the secondary electromagnetic field is configured to attenuate the primary electromagnetic field to produce a net field boundary which lies at least partly within the device boundary.

3. An aerosol generating system according to claim 1, wherein the secondary susceptor has a lower electrical resistivity than the primary susceptor.

4. An aerosol generating system according to claim 1, further comprising an electromagnetic shield positioned between the inductor and the secondary susceptor, the electromagnetic shield comprising a ferrimagnetic, non-electrically conductive material.

5. An aerosol generating system according to claim 1, wherein the inductor comprises a helical induction coil and the primary susceptor is arranged inside the helical induction coil.

6. An aerosol generating system according to claim 5, wherein the secondary susceptor comprises at least one susceptor disc positioned at an axial end of the helical induction coil.

7. An aerosol generating system according to claim 5, wherein the secondary susceptor comprises a susceptor mesh which surrounds at least part of the helical induction coil.

8. An aerosol generating system according to claim 1, wherein the secondary susceptor at least partially encloses the inductor, the primary susceptor, and the aerosol generating substrate, and wherein the secondary susceptor comprises a cup-shaped susceptor element or a pair of cup-shaped susceptor elements.

9. An aerosol generating system according to claim 1, wherein the primary susceptor and the aerosol generating substrate are integrated into a planar body having main surfaces, and wherein the inductor comprises a pair of coil plates arranged on opposite sides of the planar body and each having a first surface which faces a corresponding main surface of the planar body.

10. An aerosol generating system according to claim 9, wherein each of the coil plates has a second surface opposite the first surface, and wherein the secondary susceptor comprises a pair of susceptor plates each of which is positioned adjacent to the second surface of a respective coil plate.

11. An aerosol generating system according to claim 10, further comprising an electromagnetic shield positioned between the inductor and the secondary susceptor, the electromagnetic shield comprising a ferrimagnetic, non-electrically conductive material, wherein the electromagnetic shield comprises a pair of electromagnetic shield members, and wherein one of said electromagnetic shield members is positioned between each of the coil plates and the adjacent susceptor plate.

12. An aerosol generating system according to claim 11, wherein each of the electromagnetic shield members comprises a ferrite slab.

13. An aerosol generating system according to claim 11, further comprising an air-gap layer positioned between each of the coil plates and the adjacent electromagnetic shield member.

14. An aerosol generating system according to claim 13, wherein each of the air-gap layers includes a thermally insulating material.

15. An aerosol generating system according to claim 9, wherein the secondary susceptor acts as an electrical conductor, and wherein the aerosol generating system comprises a self-oscillating circuit formed by the inductor and the secondary susceptor.

* * * * *